United States Patent [19]

Campolini et al.

[11] Patent Number: 4,499,562

[45] Date of Patent: Feb. 12, 1985

[54] MIXER HAVING WORKHEAD OPERABLE IN MIXING AND PUMPING MODES

[75] Inventors: John Campolini; Dennis Khaan, both of London, England

[73] Assignee: Coldstream (Engineering) Limited, London, England

[21] Appl. No.: 549,902

[22] Filed: Nov. 7, 1983

[51] Int. Cl.[3] ..... B01F 5/12

[52] U.S. Cl. ..... 366/264; 415/132

[58] Field of Search ..... 366/264, 263, 265, 285, 366/286, 289, 270, 266, 262; 415/131, 132

[56] References Cited

U.S. PATENT DOCUMENTS

| | | | |
|---|---|---|---|
| 3,222,038 | 12/1965 | Ashcraft | 366/289 |
| 3,326,532 | 6/1967 | Lodge | 366/286 |
| 3,806,004 | 4/1974 | Kolkovsky | 366/264 |
| 3,889,931 | 6/1975 | Adams | 366/264 |

FOREIGN PATENT DOCUMENTS

| | | | |
|---|---|---|---|
| 904849 | 3/1945 | France | 415/131 |
| 1384436 | 2/1975 | United Kingdom . | |

*Primary Examiner*—Robert W. Jenkins
*Attorney, Agent, or Firm*—Salter & Michaelson

[57] ABSTRACT

A mixer of the kind having a work head 50 comprising a rotor 60 rotatable within a stator 70 to cause liquid to flow through the stator and having a mixing and shearing effect in the liquid. The mixer has a motor 12 which is vertically movable within a housing 10 between a raised and a lowered position, by means of a handle 30 which rotates a cam 22 engaging the housing 12. The stator 70 is fixed to the housing 12 by rods 52, and the rotor 60 is fixed to the end of the motor shaft 40, so that movement of the motor 12 moves the rotor between raised and lowered positions. In the raised position the rotor has a mixing effect. In the lowered position the rotor is at the same level as an outlet 78 extending from the stator 60, and acts to pump liquid through the outlet. The rotor can be moved from the mixing to the pumping position while it is rotating, thus giving a saving of time as compared with conventional mixers in which it is necessary to change the work head to a special pumping head when pumping is required.

7 Claims, 6 Drawing Figures

MIXER HAVING WORKHEAD OPERABLE IN MIXING AND PUMPING MODES

This invention relates to mixers.

More particularly, the invention relates to mixers of the kind having a work head comprising a rotor rotatable within a stator, the rotation effecting movement of liquid through the stator and having a mixing action on the liquid. Such mixers are known, in which the work head can be withdrawn from the vessel containing the liquid and replaced with a pump head provided with an outlet tube through which liquid is forced by rotation of the rotor to enable the liquid to be pumped from the mixing vessel.

It is an object of this invention to provide a mixer of the kind referred to, in which the mixer can be changed from a mixing to a pumping mode without the necessity of changing the work head.

This invention consists in a mixer of the kind referred to, in which the work head is provided with an outlet tube extending from the work head and the rotor is movable relative to the stator between a first position in which the rotor has a mixing action and a second position in which the rotor acts to pump liquid through the outlet tube.

Suitably, the outlet tube extends from the lower part of the work head and the rotor is vertically movable between a raised position in which the rotor has a mixing action and a lower position in which the rotor acts to pump liquid through the outlet tube.

Preferably, the work head is connected to a motor housing containing a motor, the rotor being mounted on the end of the motor drive shaft, and the motor is movable in the housing between a raised and a lower position, the rotor moving with the motor between the raised and lowered positions, and there are provided means for moving the motor from one position to the other.

In one form of the invention, the means for moving the motor comprises a lever pivoted to a member attached to the motor and having a cam surface acting against the motor housing so that pivoting of the lever effects movement of the motor between the said two positions.

Figure 1:
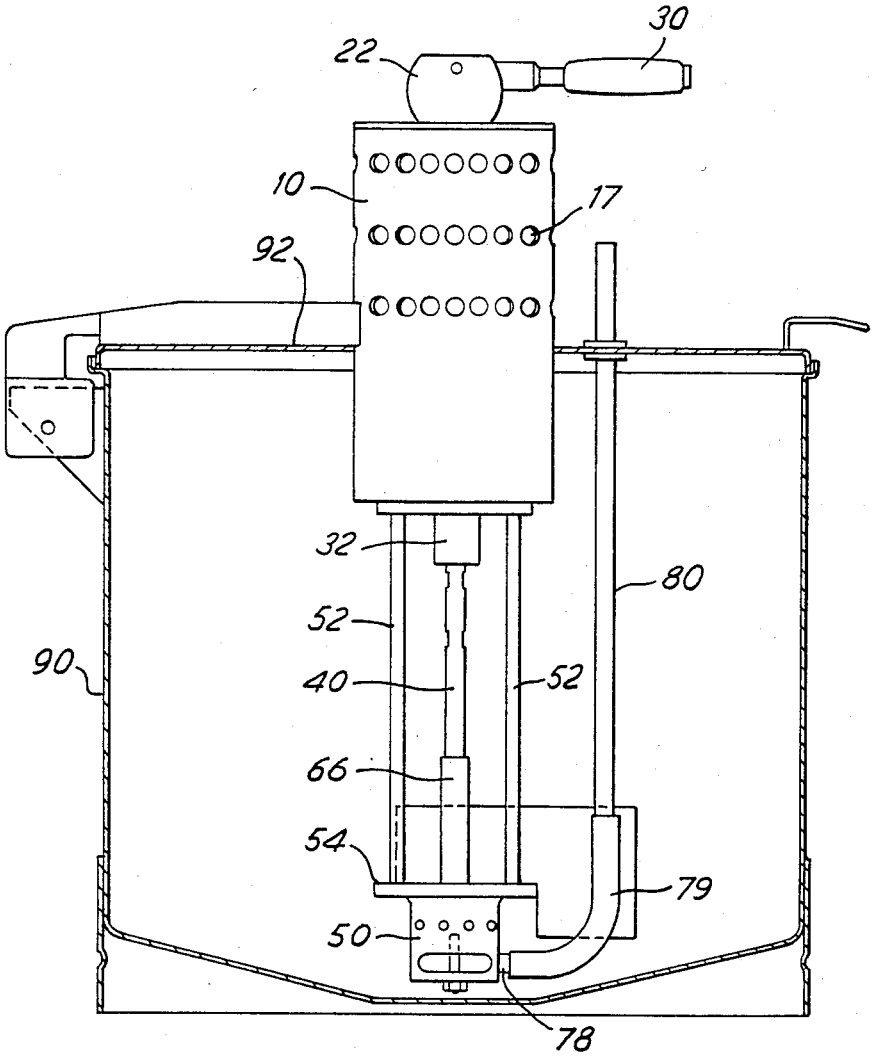
Figure 2:
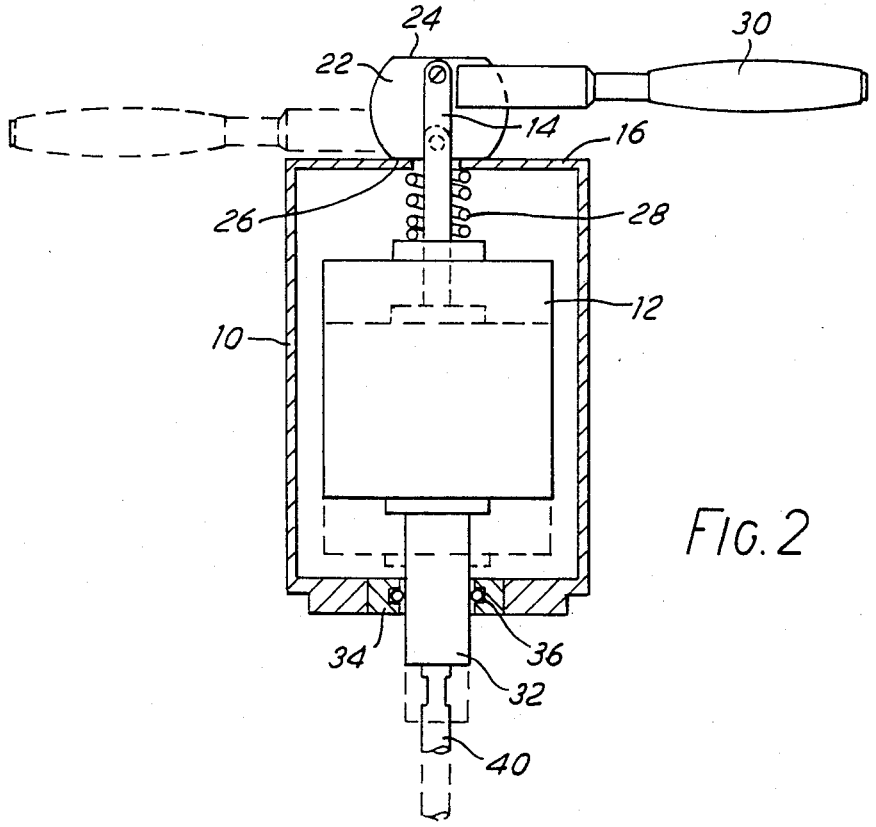
Figure 3:
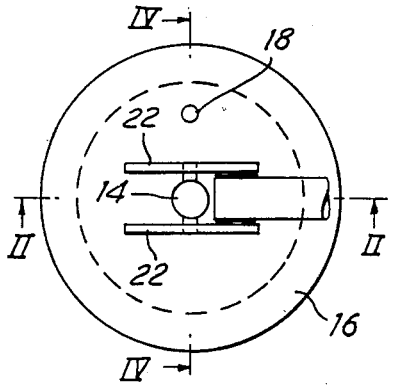
Figure 4:
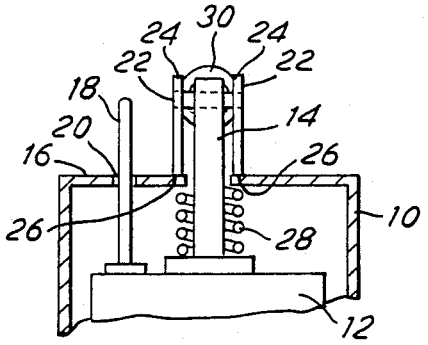
Figure 5:
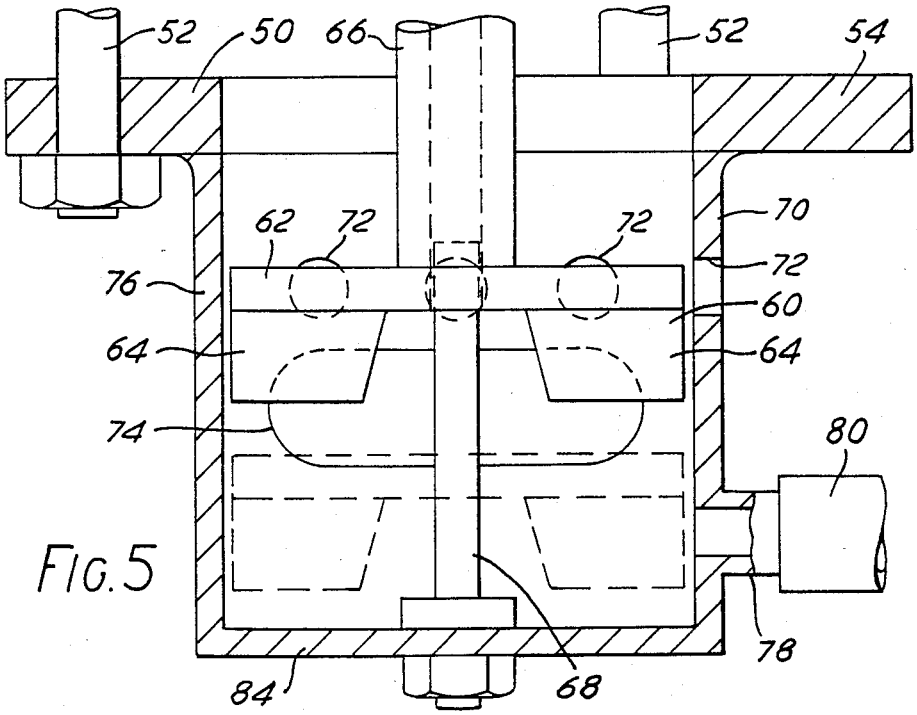
Figure 6:
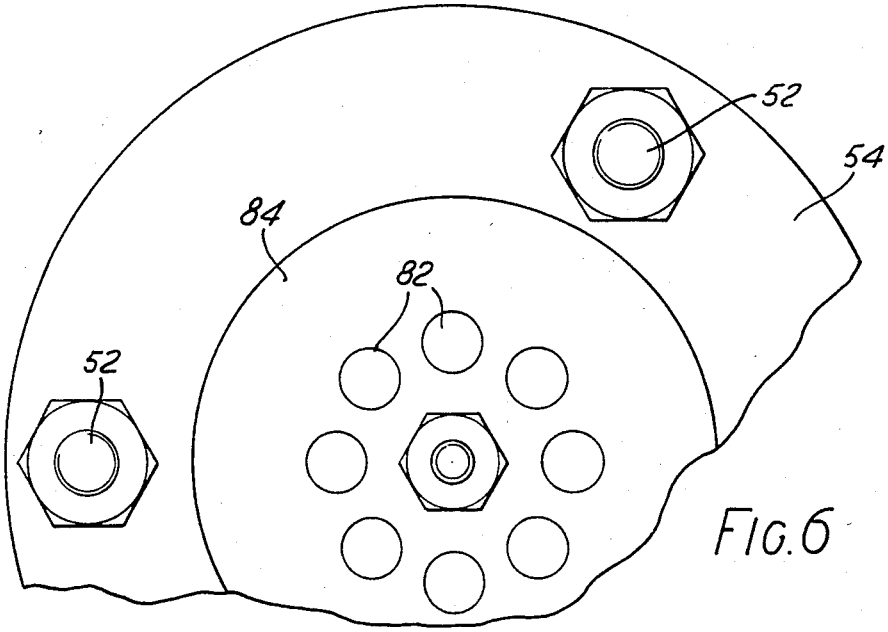

One embodiment of the invention will now be described, by way of example, with reference to the accompanying diagrammatic drawings, in which:

FIG. 1 is a side elevation of a mixer in accordance with the invention, shown fitted to a mixing vessel, FIG. 2 is a vertical cross-section, on a larger scale, through the motor housing of the mixer, FIG. 3 is a plan view of the mixer, FIG. 4 is a fragmentary view, partly in cross-section on line IV–IV of FIG. 3, FIG. 5 is a vertical cross-section through the work head of the mixer, FIG. 6 is a bottom plan view of the work head.

Referring to the drawings, a mixer comprises a motor housing 10 and a work head 50. The motor housing contains a motor 12 which, as described below, is movable between upper and lower positions by means of a handle 30. The work head 50 has a rotor 60 connected to the motor 12 by a shaft 40 and rotatable within a stator 70. Vertical movement of the motor 12 moves the rotor 60 between an upper position in which it has a mixing and emulsifying action and a lower position in which it acts to pump liquid through the outlet pipe 80.

The motor 12 is supported by a centre spigot 14 which is fixed to the frame of the motor and projects upwardly through the top plate 16 of the motor housing 10. A steadying spigot 18 fixed to the frame of the motor and spaced from the centre spigot 14 also projects upwardly through a bore 20 in the top plate 16, to prevent rotation of the motor 12 relative to the housing 12. The upper part of the centre spigot 14 extends between two cam plates 22 to which it is pivoted for rotation about a horizontal axis. A handle 30 has a portion extending between and fixed rigidly to the cam plates. The handle extends from the cam plates so that it can be turned to rotate the cam plates about a horizontal axis. The pivoted connection of the spigot 14 to the cam plates 22 is eccentrically arranged, so that rotation of the cam plates effects vertical movement of the spigot 14 and therefore of the motor 12, the cam plates acting against the top plate 16 of the motor housing 10. Each of the cam plates 22 has two straight cam faces 24 and 26 which engage the top plate 16 of the motor housing 10 when the motor 12 is in its lowermost and uppermost positions respectively, so that the motor 12 will remain in one or other or those positions when the handle is released. A compression spring 28 acting between the motor 12 and the top plate 16 of the housing 10 assists in holding the motor positively in either of the two positions. Movement of the handle 30 from the solid line position to the broken line position in FIG. 2 moves the motor 12 from its upper position, shown in solid lines, to its lower position, shown in broken lines.

Fixed to the lower end of the frame of the motor 12 is a coupling member 32 which is slidable in a housing 34 fixed in a bore in the bottom wall of the motor housing 10. A seal 36 between the coupling member 32 and the housing 34 prevents liquid from entering the housing 10. The motor shaft 40 extends through a seal in the coupling member 32. The motor housing 10 may be formed with ventilation holes 17.

The stator 70 of the work head 50 is carried on a frame consisting of three vertical rods 52 which are fixed at their upper ends to the motor housing and at their lower ends to an annular plate 54 to which the stator is welded. The stator 70 is generally of conventional form, except for the provision of an outlet 78. The stator is generally cup-shaped, having a cylindrical side wall 76 and a bottom wall 84. The side wall 76 has a number (e.g. twelve) of holes 72 spaced around the upper part of the wall, and a number (e.g. three) of larger cut-outs 74 spaced around the lower part of the wall. A number of holes 82 are also formed in the bottom wall 84. The outlet 78 extends outwards from the cylindrical wall 76 near the bottom of the stator, below the level of the cut-outs 74.

The rotor 60 is also of conventional form, consisting of a plate 62 to the underside of which are fixed a number (e.g. four) of vanes 64, the vanes extending at right angles to the plate 62. The rotor is a close fit in the stator, the outer vertical edges of the vanes 64 sweeping close to the cylindrical wall 76 of the stator so as to have a shearing action on the material to be mixed and emulsified.

The plate 62 is fixed to a hollow shaft 66 forming an extension of the motor shaft 40. A rod 68 fixed to the bottom wall 84 of the stator 70 projects upwards into a bore in the shaft 66, to provide a bearing on which the rotor 70 is rotatable and slidable.

When the motor 12 is in its uppermost position, the rotor 60 is located in the upper part of the stator 70, in a position generally between the holes 72 and the cutouts 74, as shown in solid lines in FIG. 5. When the motor 12 is moved to its lowermost position, the rotor 60 is lowered to a position, shown in broken lines in FIG. 5, in which it is near the bottom of the stator, and is at the same level as the outlet 78. In its uppermost position, rotation of the rotor 60 in the stator 70 has a mixing and shearing or emulsifying action on liquid which is forced through the stator by the action of the rotor, as in a conventional mixer/emulsifier, the liquid entering through the open top of the stator and through the cut outs 74, and being forced out through the holes 72. When the rotor is in the lower position rotation of the rotor forces liquid into the outlet 78, and acts to pump liquid out through the outlet pipe 80. The holes 82 in the lower wall 82 of the stator allow liquid to be drawn in from beneath the stator.

In operation, the rotor 60 can be moved from the upper to the lower position whilst it is still rotating, by turning the handle 54 to lower the motor 12, so that the change from the mixing mode to the pumping mode can be effected speedily, without the loss of time which is involved in changing the work head.

FIG. 1 shows the mixer fixed to the lid 92 of a stainless steel mixing vessel 90. The outlet 78 is connected to the outlet pipe 80 through a length of PVC tubing 79. The outlet pipe 80 extends upwardly through the lid 92, and is connected to a suitable outlet line (not shown). A valve may be provided in the outlet line, to control the flow of liquid pumped from the vessel.

It will be appreciated that modifications could be made in the described embodiment. For example, in place of the lever and cam mechanism described, the motor could be raised and lowered by means of a handle rotatable about a vertical axis, acting on the motor through a spiral cam mechanism. Other mechanisms could be used for raising and lowering the motor.

I claim:

1. A mixer having a work head comprising a rotor rotatable within a stator, the stator having inlet and outlet holes, said outlet holes being arranged in a cylindrical wall of the stator, and the rotor having vanes fitting closely within the stator so that rotation of the rotor causes liquid to be drawn in through the inlet holes and expelled through the outlet holes thereby effecting mixing of the liquid, characterised in that the cylindrical wall of the stator has an outlet aperture and an outlet tube which communicates with the outlet aperture and extends from the head, and in that the rotor is axially movable relative to the stator between a first position in which the vanes of the rotor move past the outlet holes to effect mixing of the liquid and a second position in which the vanes of the rotor are at the same level as the outlet aperture so that rotation of the rotor causes liquid to be expelled through the outlet tube.

2. A mixer as claimed in claim 1, in which the outlet tube extends from the lower part of the work head and the rotor is vertically movable between a raised position in which the rotor has a mixing and emulsifying action and a lower position in which the rotor is at the same level as the outlet and acts to pump liquid through the outlet tube.

3. A mixer as claimed in claim 2, in which the work head is connected to a motor housing containing a motor, the rotor being mounted on the end of the motor drive shaft, and the motor is movable in the housing between a raised and a lower position, the rotor moving with the motor between the raised and lowered position, and there are provided means for moving the motor from one position to the other.

4. A mixer as claimed in claim 3, in which the means for moving the motor comprises a lever pivoted to a member attached to the motor and having a cam surface acting against the motor housing so that pivoting of the lever effects movement of the motor between the said two positions.

5. A mixer as claimed in claim 4, in which the lever is arranged above the top wall of the motor housing, the cam acting downwards against the said top wall.

6. A mixer as claimed in claim 5, in which a compression spring acts between the motor and the top wall of the motor housing, to bias the motor downwards.

7. A mixer as claimed in claim 1, in which the stator is suspended from the motor housing by a plurality of vertical members.

* * * * *